US005979203A

United States Patent [19]

Radocaj

[11] Patent Number: 5,979,203

[45] Date of Patent: Nov. 9, 1999

[54] APPARATUS FOR SPIN-FORMING A CIRCULAR BODY FROM A FLAT BLANK METAL WORKPIECE

[76] Inventor: Mijo Radocaj, 1912 Amherst Rd., NE., Massillon, Ohio 44646

[21] Appl. No.: 09/035,570

[22] Filed: Feb. 19, 1998

[51] Int. Cl.[6] ..... B21H 1/04

[52] U.S. Cl. ..... 72/71; 72/91; 29/892.2

[58] Field of Search ..... 72/71, 91, 110; 29/892.2, 892.3

[56] References Cited

U.S. PATENT DOCUMENTS

| | | | |
|---|---|---|---|
| 3,225,425 | 12/1965 | Skinner et al. | 29/159 R |
| 3,517,541 | 6/1970 | Wagner | 29/892.2 |
| 3,540,395 | 11/1970 | Skinner | 113/116 |
| 3,648,500 | 3/1972 | Vaill | 72/71 |
| 3,758,930 | 9/1973 | Frost et al. | 29/159 R |
| 3,828,619 | 8/1974 | Frost et al. | 74/230.01 |
| 3,877,271 | 4/1975 | Maddock | 72/45 |
| 4,055,977 | 11/1977 | Haswell | 29/892.3 |
| 4,523,446 | 6/1985 | Müller | 72/71 |

FOREIGN PATENT DOCUMENTS

| | | | |
|---|---|---|---|
| 0 490 840 | 6/1992 | European Pat. Off. | 72/71 |

*Primary Examiner*—Lowell A. Larson
*Attorney, Agent, or Firm*—Paul E Milliken; Lee A Germain

[57] ABSTRACT

A machine has upper and lower die members which clamp a disk blank between them and maintain the disk blank axially on a machine vertical axis and planarly on a machine horizontal axis. The die members and disk blank are rotated via a main motor which drives one of the die members through a spur-ring gear configuration or directly along the machine vertical axis. Splitting and swaging tools are positioned to move along the machine horizontal axis to form the disk blank outer peripheral edge into a pulley groove while a splitting-swaging tool carried within a chamber formed by the die members splits and swages a disk blank bore to form upper and lower bearing retaining flanges. Various means for moving the splitting-swaging tool off of the machine vertical axis to a parallel axis are disclosed as well as various means for exact positioning of the disk blank axially on the machine vertical axis.

20 Claims, 7 Drawing Sheets

FIG.-1A
FIG.-1B
FIG.-1C
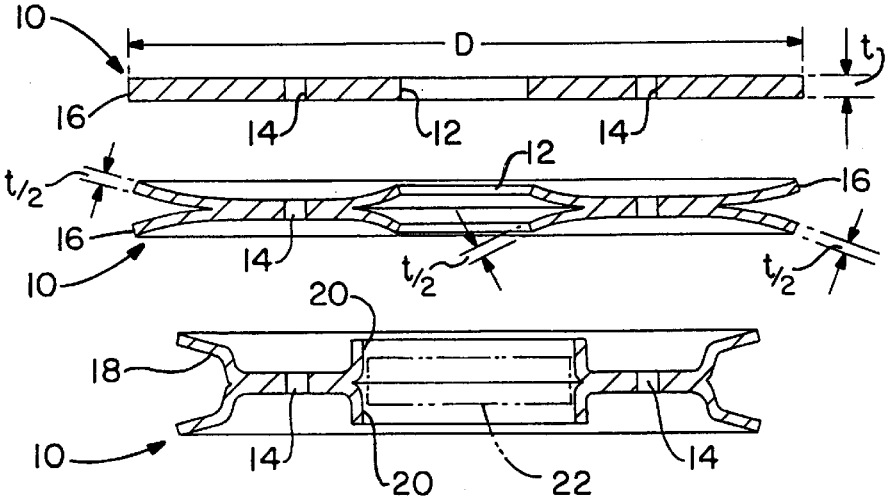
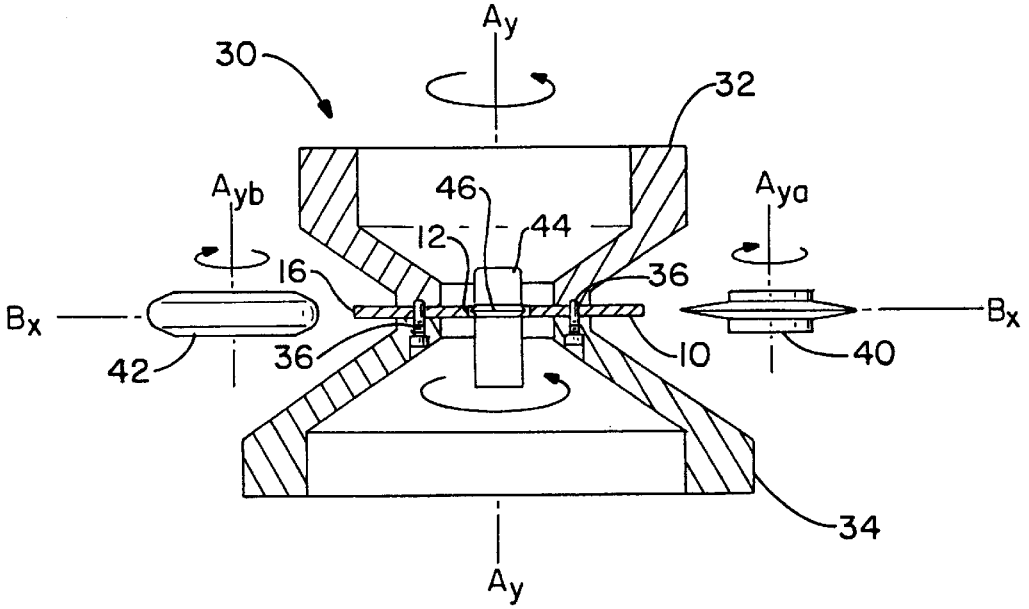
FIG.-2

APPARATUS FOR SPIN-FORMING A CIRCULAR BODY FROM A FLAT BLANK METAL WORKPIECE

FIELD OF THE INVENTION

This invention generally pertains to machine operations as applied to metal fabrication and, more particularly, to splitting techniques for forming a one-piece pulley or like-type body from a solid circular metal blank of material.

More specifically, this invention provides an apparatus or machine which effects splitting of an outer peripheral edge of a solid circular metal blank to form a pulley groove while also splitting an inner bore peripheral edge to form a flanged bearing retainer.

BACKGROUND OF THE INVENTION

In the art of metal fabrication, methods are disclosed for creating pulleys, sheaves, and like-type bodies from a solid circular metal blank by splitting the exposed edges of the blank. For example, U.S. Pat. No. 3,758,930 to Frost et al suggests a method of splitting a metal blank about its peripheral edge to form a pulley groove and also suggests splitting of an inner bore peripheral edge to form a bearing retainer. U.S. Pat. No. 3,828,619 also to Frost et al suggests a pulley configuration as may be made by the method of the '930 patent.

In addition to the above-referenced patents, U.S. Pat. No. 3,225,425 to Skinner et al and U.S. Pat. No. 4,523,446 to M üller suggest methods of metal splitting to form a pulley groove or a tire retaining wheel flange respectively.

While methods of metal splitting to form pulleys and like-type bodies are disclosed in the prior art, an actual apparatus or machine to accomplish the suggested methods is not disclosed.

It is, therefore, in accordance with at least one aspect of the invention an object to provide a machine which effects splitting and swaging of an outer peripheral edge of a solid disk blank to form a pulley groove configuration while also splitting and simultaneously swaging of an inner bore edge to form upper and lower flanges for retaining a bearing.

SUMMARY OF THE INVENTION

The above-mentioned aspect and other aspects and advantages of the present invention are accomplished in a machine having vertical Ay and horizontal Bx axes to spinform a solid disk blank having a central bore into a pulley configuration exhibiting an outer peripheral pulley groove and a flanged bore bearing retainer, the machine comprising in combination:

- die means for positioning and maintaining the disk blank on the Ay and Bx axes by clamping the disk blank between an upper and lower die means;
- a power source for effecting rotational motion of one of the die means to effect rotation of the die means and the disk blank;
- a splitting tool positioned and movable on the Bx axis to engage and split the disk blank peripheral edge;
- a swaging tool positioned and movable on the Bx axis to engage and swage the disk blank peripheral edge to a pulley groove configuration;
- a splitting-swaging tool positioned on the Ay and Bx axes and movable to a parallel Ayc axis to engage the disk blank bore and effect splitting of the bore while also swaging of the bore to form upwardly and downwardly oriented flanges;

- a rotatable spindle adapted for mounting of the splitting-swaging tool on the machine Ay axis and movable horizontally such that the tool splits and swages the disk blank bore;
- a means for providing lubrication of the tools when in operation;
- a source of power to provide positioning and controlling motions of the various machine members; and
- a controller to provide timing and sequence signals to the various members such that all of the machine operations are accomplished according to predetermined specifications.

BRIEF DESCRIPTION OF THE DRAWINGS

The various features and advantages of the present invention will be better understood and appreciated from a consideration of the following detailed description when taken in conjunction with the accompanying drawings in the several figures in which like-reference numerals and/or letters indicate like elements and in which:

FIG. 1A is an elevational view, in cross-section, of a solid metal circular disk blank as may be applied to the formation of a pulley or like-type body in the machine of the present invention;

FIG. 1B is an elevational view, in cross-section, of the disk blank shown in FIG. 1A illustrating a splitting operation which effects forming of the disk blank into a pulley body;

FIG. 1C is an elevational view, in cross-section, of a production pulley as made by a metal splitting and swaging machine operation;

FIG. 2 is an elevational view, in partial cross-section and partially schematic, illustrating machine operations as may be accomplished by the present invention;

DETAILED DESCRIPTION OF THE PREFERRED EMBODIMENTS

Figure 3:
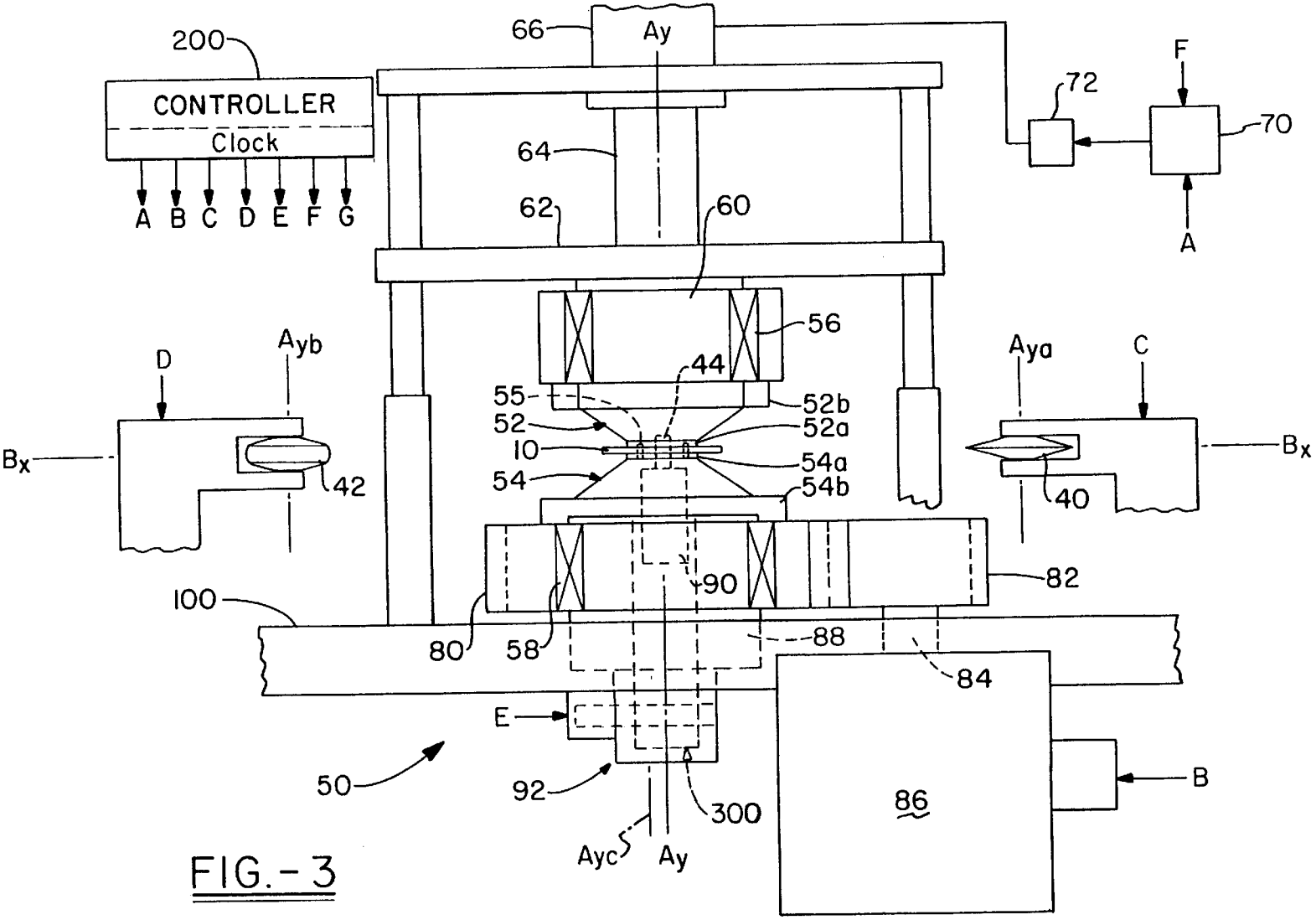
FIG. 3 is an elevational view, in partial cross-section and partially schematic, illustrating a machine in accordance with the present invention.

With reference to the drawings, FIGS. 1A, 1B, and 1C illustrate a method of converting a solid metal circular disk blank into a formed operational body such as, for example, a pulley as may be driven into rotation by a belt in any known mechanical drive operation. In FIG. 1A, a disk blank is shown and generally indicated by reference numeral 10 and it is characterized by a thickness dimension "t" and an overall diameter dimension "D". The thickness "t" and diameter "D" are predetermined specifications which are necessary such that the requirements imposed on a final product configuration and its application will be met and this will be apparent as this description proceeds.

The disk blank 10 may be further characterized by a central axial bore 12 and include at least two positioning bores 14 the purpose of which will be described hereinafter. In FIG. 1B, the disk blank 10 is shown as edge splitting has been initiated wherein the outer peripheral edge 16 is split into two halves each exhibiting a thickness dimension "t/2".

In a like manner, the bore 12 is split into two halves each exhibiting a thickness dimension "t/2". A continued splitting and ultimate swaging of the outer and bore edges 16 and 12 respectively results in a pulley product as shown in FIG. 1C. Thus, a circular disk blank 10 is converted into a body characterized by a pulley groove indicated at reference numeral 18 and a bore 12 formed into a flanged configuration 20 which may be applied to contain a bearing as indicated by ghost lines at reference numeral 22.

Referring now to FIG. 2 of the drawings, a machine operation in accordance with the present invention for forming a pulley body as shown in FIG. 1C is illustrated and generally indicated by reference numeral 30. The figure is a partial elevational view and is partially schematic for the purpose of illustrating the positioning and operational steps which are necessary in a machine operation to form the pulley body of FIG. 1C. In the figure, a circular disk blank 10 similar to that shown in FIG. 1A is mounted between an upper die member 32 and a lower die member 34 and it is axially positioned on a vertical machine axis indicated by line Ay—Ay in the figure. Positioning bores 14 in the disk blank 10 are matched with at least a pair of positioning die studs 36 in the lower die member 34. The die members 32,34 and the disk blank 10 are all, therefore, rotatable about the Ay machine axis. In a position exterior of the die members 32,34 is a splitting tool 40 which is movable along the Bx horizontal axis and it rotatable about a parallel Aya vertical axis. The splitting tool 40 moves along the Bx axis such that it makes engagement with the outer peripheral edge 16 of the disk blank 10 to effect splitting of the disk blank edge 16 into two halves of thickness dimension "t/2" as shown in FIG. 1B of the drawings. Also in a position exterior of the die members 32,34 is a swaging tool 42 which is movable along the Bx horizontal axis and it is rotatable about a parallel Ayb vertical axis. From this description it can be appreciated that the tools 40 and 42 are instrumental in splitting and forming of the pulley groove 18 as illustrated in FIG. 1C.

Continuing with reference to FIG. 2, a third tool 44 is positioned within the disk blank bore 12 via a vertical motion along the Ay machine axis. The tool 44 is characterized by a splitting edge 46 which moves along the Bx horizontal axis to engage the disk blank bore peripheral edge and effect splitting of the bore edge into two halves each exhibiting a thickness dimension "t/2". The tool 44 is also characterized by a shape which effects swaging of the upper half portion vertically upwardly while also effecting swaging of the lower half portion vertically downwardly to thus form bearing retaining flanges 20 as shown in FIG. 1C. In this respect, it should be pointed out that the machine of this invention is capable of forming both upwardly and downwardly oriented bearing retaining flanges simultaneously in a single machine operation. This will be made apparent as the description proceeds. In addition, it will be apparent that the pulley groove 18 may exhibit many and various configurations and this is dependent upon the shape of the swaging tool being applied to the disk blank peripheral edge 16.

Referring to FIG. 3 of the drawings, a machine according to a first embodiment of the invention is illustrated schematically and generally indicated by reference numeral 50. The machine 50 is characterized by an upper die member 52 and a lower die member 54 and these are mounted for rotational motion about a vertical Ay machine axis as shown. The upper die member 52 is a cone-shaped piece having a lower end 52*a* which is adapted for engagement with a circular disk blank 10 and an upper end 52*b* which is adapted for mounting to a carrier member 60 via bearings 56. The carrier member 60 is mounted to a top frame or ram member 62 which is carried by a movable piston rod 64. The rod 64 is vertically movable within a hydraulic cylinder 66 via hydraulic pressure in a conventional manner. A power source 70 feeds a distributor 72 which provides the hydraulic power to the cylinder 66 and in this way the upper die member 52 is forced downwardly into engagement with a face surface of the circular disk blank 10. The lower die member 54 is also a cone-shaped piece having an upper end 54*a* in engagement with an opposite face surface of the circular disk blank 10 and a lower end 54*b* mounted to a carrier member 80 via bearings 58. The carrier member 80 is a ring gear driven into rotation by a spur gear 82 affixed to a motor shaft 84. Of course, the motor shaft 84 is driven via a motor 86 in the usual manner.

Because the upper die member 52 and the lower die member 54 are interconnected thru two or more positioning studs 55 carried by the lower die member 54, both die members are driven into rotation via the spur-ring gear configuration. The circular disk blank 10, therefore, is also driven into rotational motion about the Ay machine axis by this arrangement.

Mounted within the carrier member 80 is a tool-holding spindle 90 which is adapted for carrying a splitting-swaging tool 44. The splitting-swaging tool 44 is rotatable within the spindle 90 while the spindle is also adapted for moving the tool 44 to a position on a parallel axis indicated in the figure at reference Ayc. In moving the tool 44 to the Ayc axis, engagement of the working surfaces of the tool with the disk blank bore 12 is achieved and the bore is split as shown in FIG. 1B and swaged as shown in FIG. 1C. The movement of the spindle 90 is accomplished by various means either mechanically or hydraulically and these means will be illustrated and described hereinafter. In any event, the means is indicated generally in the figure at reference numeral 92 as such may be mounted to the machine base frame 100.

Figure 4:
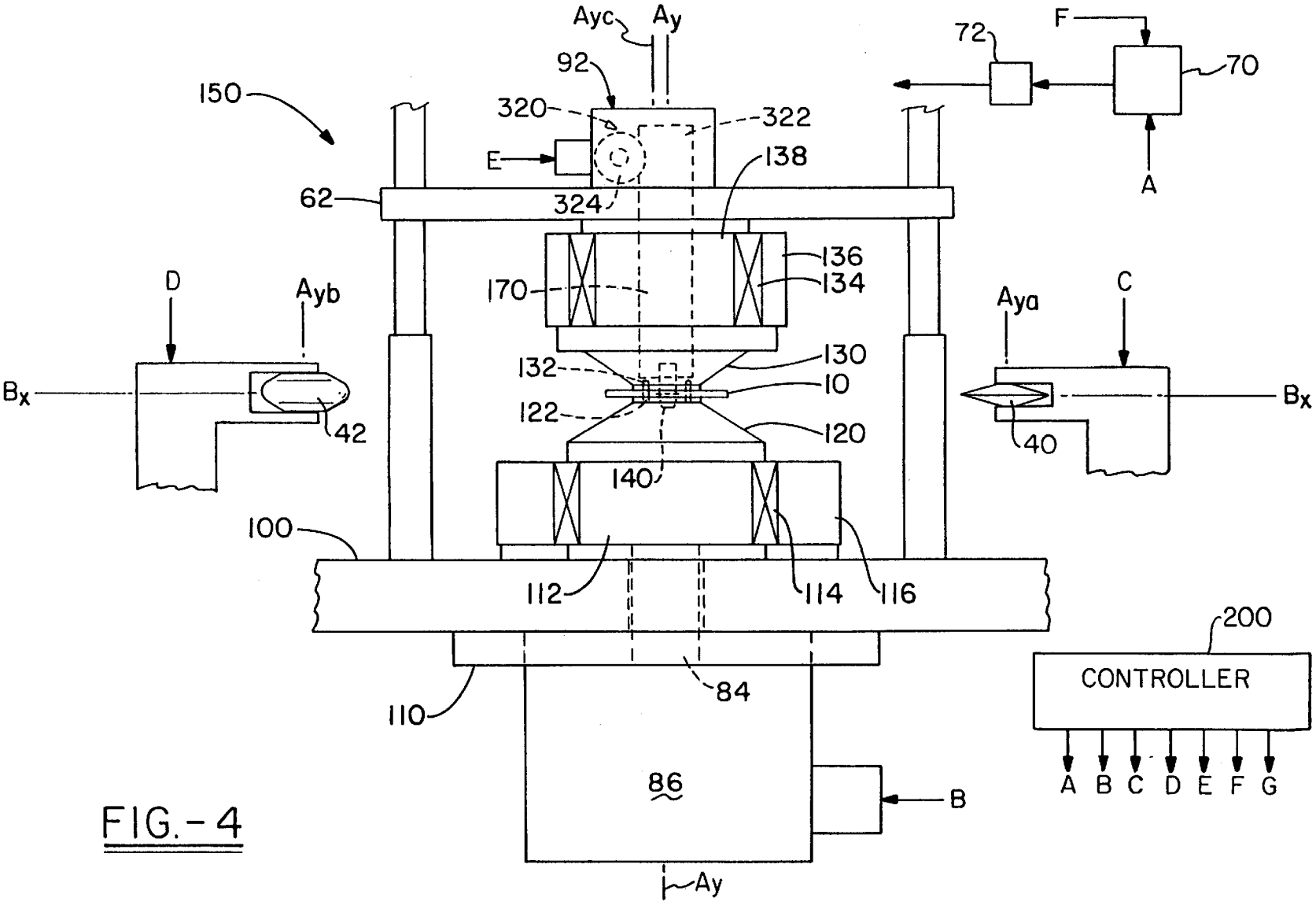
FIG. 4 is an elevational view, in partial cross-section and partially schematic, illustrating an alternative configuration of the machine shown in FIG. 3.

Referring now to FIG. 4 of the drawings, an alternative configuration for the machine 50 shown in FIG. 3 is illustrated and generally indicated by reference numeral 150.

Again, the figure is primarily schematic and comprises a drive motor 86 which is alternatively mounted to the machine base frame 100 such that its output shaft 84 is rotatable about the machine Ay axis. The motor 86 is positioned and carried by a mounting base member 110 and the output..shaft 84 is connected to a spindle 112 which is rotatable within a bearing 114 carried by a ring member 116 mounted to the base frame 100.

A cone-shaped die member 120 is carried by the spindle 112 and it may be characterized by at least a pair of positioning studs 122 adapted for matching engagement within the bores 14 in the disk blank 10 such that the disk blank is both vertically and horizontally located with reference to the machine Ay axis and the horizontal Bx axis. Other techniques for locating the disk blank 10 may be used and these will be illustrated and discussed hereinafter. In any case, the studs 122 extend to engage a top-mounted cone-shaped die member 130 via matching bores 132. The die member 130 is mounted for rotataional motion about the machine Ay axis via bearings 134 carried within a ring member 136. The ring member 136 is also rotatable about the machine Ay axis while a base member 138 is mounted to the top frame or ram member 62 for vertical movement along the machine Ay axis via hydraulic or mechanical means 64,66 shown in FIG. 3.

Mounted axially within the upper die member 130 is a splitting-swaging tool 140 which is carried by a rotatable and movable spindle 170. The spindle 170 is adapted to move the tool 140 from the machine Ay axis to a parallel Ayc axis and such means is generally indicated at reference numeral 92. Again, the motion of the tool 140 from the Ay axis to the Ayc axis effects splitting and swaging of the disk blank bore 12 as illustrated in FIGS. 1B and 1C.

Figure 5:
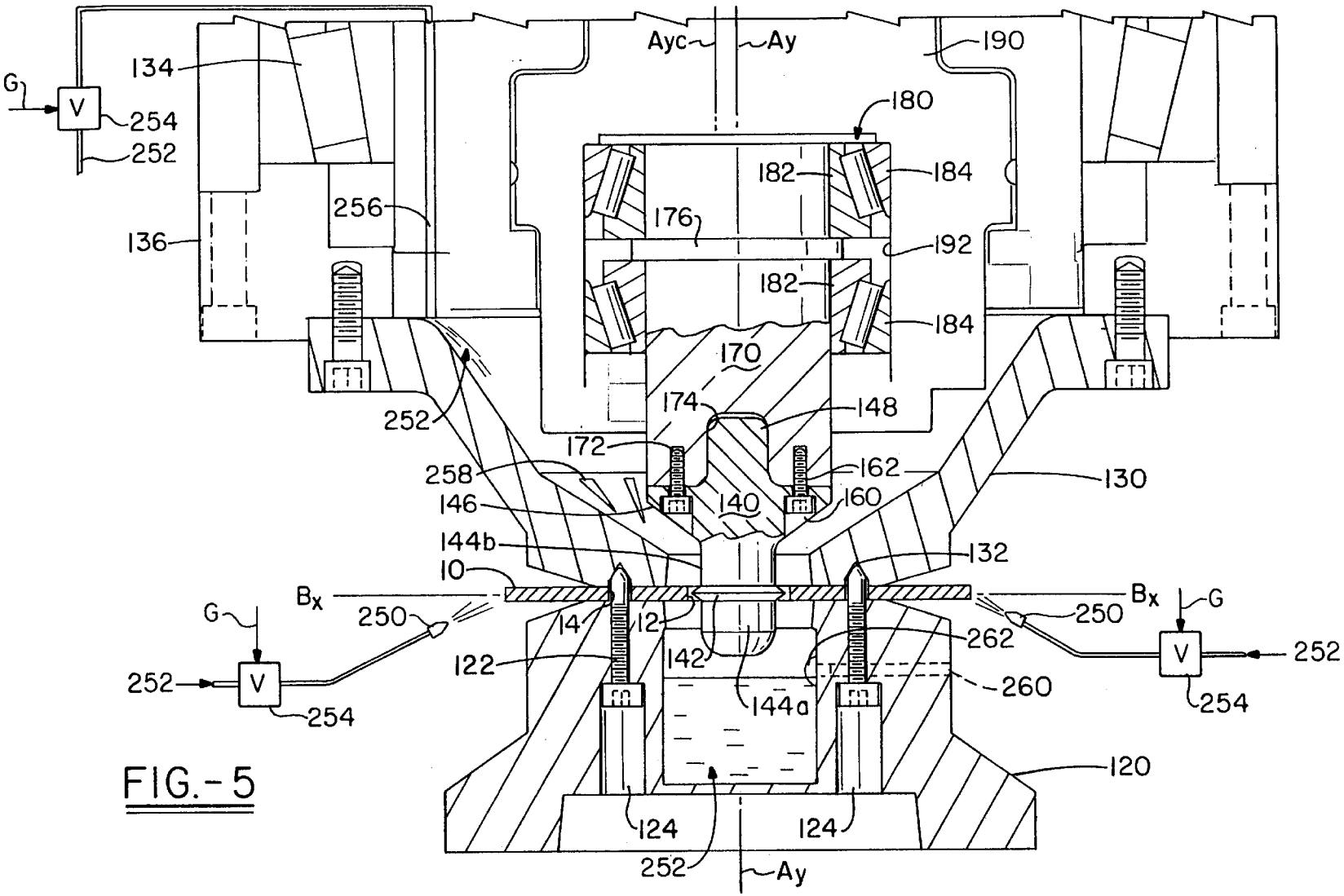
FIG. 5 is an enlarged elevational view, in partial cross-section, illustrating a cutting and swaging mechanism which forms a primary portion of the machine comprising this invention.

Referring to FIG. 5 of the drawings, an enlarged showing of the machine mechanism which effects splitting and swaging of the disk blank bore 12 is illustrated. In the figure, a disk blank 10 is firmly clamped between a bottom die member 120 and a top die member 130 via a force exerted by the means 62,64 and 66 shown in FIGS. 3 and 4. In this embodiment, the bottom die member 120 has at least a pair of positioning stud bolts 122 which are threaded into bores 124 and which pass through the locating bores 14 in a disk blank 10 and advance into matching bores 132 in the upper die member 130. In this way, the disk blank 10 is securely maintained for rotational motion about the machine Ay axis and within the horizontal plane of the Bx axis. The bottom die member 120 is carried by a rotatable spindle 112 which is connected to the drive motor shaft 84 as shown in FIG. 4. Accordingly, rotational motion of the upper die member 130 is achieved through the interconnection with the lower die member 120. The upper die member 130 is rotationally mounted by way of a ring member 134 through a bearing 134.

The splitting-swaging tool 140 is characterized by a splitting edge 142, a lower swaging surface 144*a,* and an upper swaging surface 144*b.* The swaging surfaces 144*a,* 144*b* effect formation of bearing retainer flanges 20 as shown in FIG. 1C of the drawings. The tool 140 is further characterized by a tapered flange portion 146 and an upper stud portion 148. The tapered flange portion 146 has at least one pair of mounting bores 160 into which bolts 162 may pass for engagement with threaded bores 172 in the upper rotatable spindle 170 The spindle 170 has a bore 174 into which the stud extension 148 of the tool 140 is seated and maintained on the machine Ay axis during start-up of a machine operation. The spindle 170 is further characterized by an annular flange 176 which carries inner bearing races 182 of bearings indicated generally at reference numeral 180. The outer bearing races 184 are mounted within a bore 192 in a member 190 which is movable horizontally such that splitting and swaging actions of the tool 140 are accomplished.

It will, of course, be recognized that a metal splitting and swaging operation as described will require lubrication and/or cooling of the tools 40,42 and 44,140 while the disk blank 10 is being worked. Lubrication is accomplished by way of spray nozzles 250 which direct a suitable pressurized lubricant 252 into the working areas of tools 40 and 42 which are located outside of the die members 120 and 130. The splitting and swaging tool 44,140 receives lubricant 252 through a supply pathway indicated at 256 which is within the confines of the machine itself. The lubricant 252 flows downwardly into the chamber formed by the upper die member 130 where spinning action distributes it to the working area of the tool. Of course, various type vanes 258 may be configured into the inside surface of the die member 130 to facilitate distribution of the lubricant 252 where it is needed most. The lubricant 252 continues flowing downwardly through the disk blank bore 12 and into the chamber formed by the lower die member 120 as illustrated in the drawing. When the lubricant reaches a particular level within the lower die member, it may be drawn off through one or more ports 260. The ports 260 may be closed by a plug 262 such that lubricant is retained in the chamber and thus available at startup of a machine operation when the supply through the pathway 256 is turned off.

Figure 6:
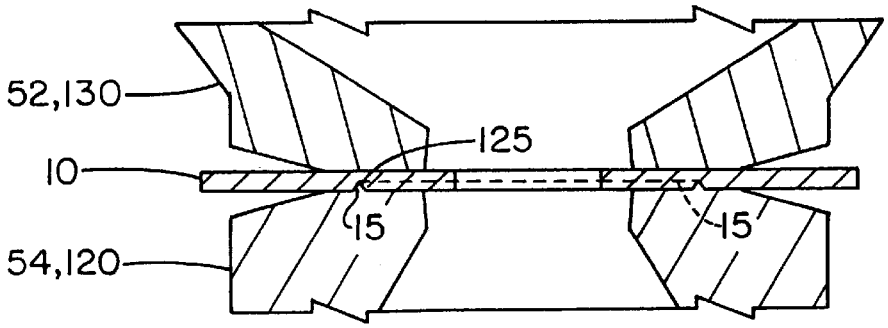
FIG. 6 is an elevational view, in cross-section, of a portion of the machine shown in FIG. 5 illustrating another clamping configuration of the circular disk blank as may be applied to this invention.
Figure 7:
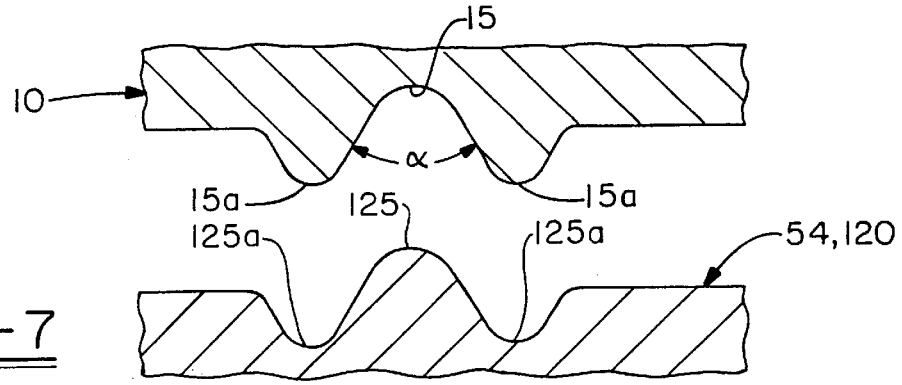
FIG. 7 is a greatly enlarged elevational view, in cross-section, through the disk blank and a portion of the lower die member shown in FIG. 6 as taken in the area effecting clamping action.

Referring to FIGS. 6 and 7, an alternative configuration for positioning and mounting of a circular disk blank 10 is illustrated in a partial elevational view in the area of the disk blank as it is clamped between two die members 120 and 130. This configuration replaces the one illustrated in FIGS. 3–5 comprising at least two positioning studs or bolts 122,162.

Referring to FIG. 6 of the drawings, the disk blank 10 is configured with an annular groove 15 in at least one surface instead of the locating bores 14 as shown in FIGS. 1A–1C. The lower die member 120 is configured with a matching raised annular ring 125 on its surface instead of the locating studs or bolts 122 and this registers with the groove 15 in the disk blank 10. When the upper die member 130 is lowered into forceful engagement with the disk blank 10, sufficient frictional egagement exists between the die members 120, 130 and the disk blank 10 such that it cannot move relatively with respect to either of them. This is so even when the machine splitting and swaging operations are in effect.

Referring to FIG. 7, a greatly enlarged showing of the groove 15 in the disk blank 10 and of the annular raised ring on the surface of the lower die member 120 are illustrated. It is recognized that, when a workpiece is stamped to form a groove in the piece, material comprising the workpiece will be displaced from the groove and form flashing material 15*a* on the inside and outside edges of the groove. The groove, of course, takes the angular shape of the stamping tool and the included angle formed is indicated at $\alpha$ in the figure. The annular ring 125 on the surface of the die member 120 is shaped to the same included angle $\alpha$ and grooves 125*a* are provided to accomodate the flashing material 15*a.* Thus, the annular raised ring 125 and groove 15 fall into registration when the disk blank 10 is placed onto the surface of the die member 120. This insures that the disk blank 10 is also in registration with the machine Ay axis as required for machine operations.

Figure 8:
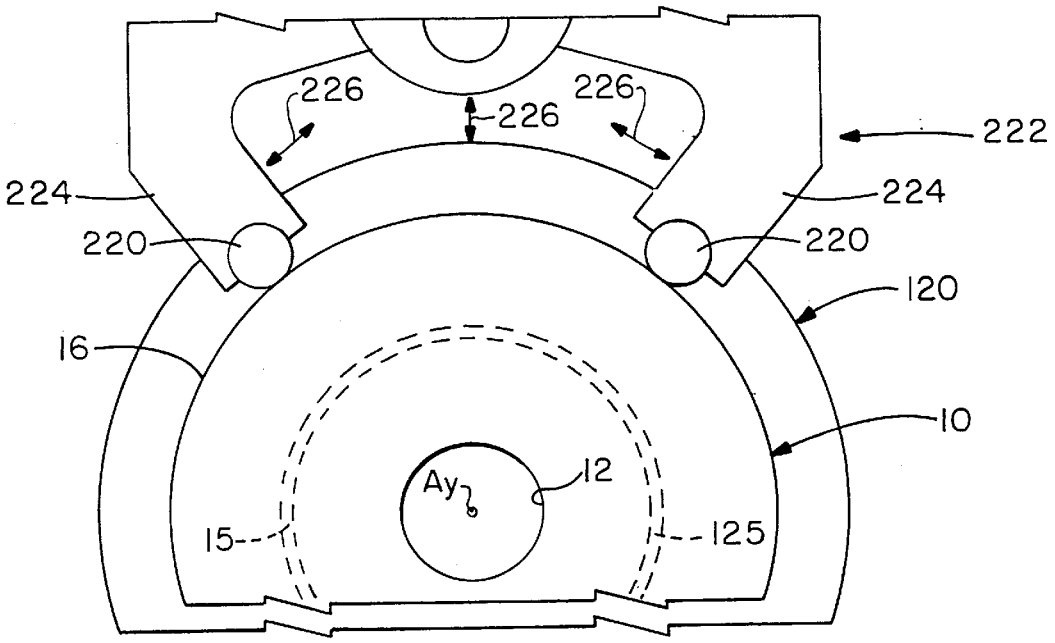
FIG. 8 is a partial plan view of the lower die member and circular disk plank illustrating a technique for insuring positioning of the disk blank axially on the machine Ay axis.
Figure 9:
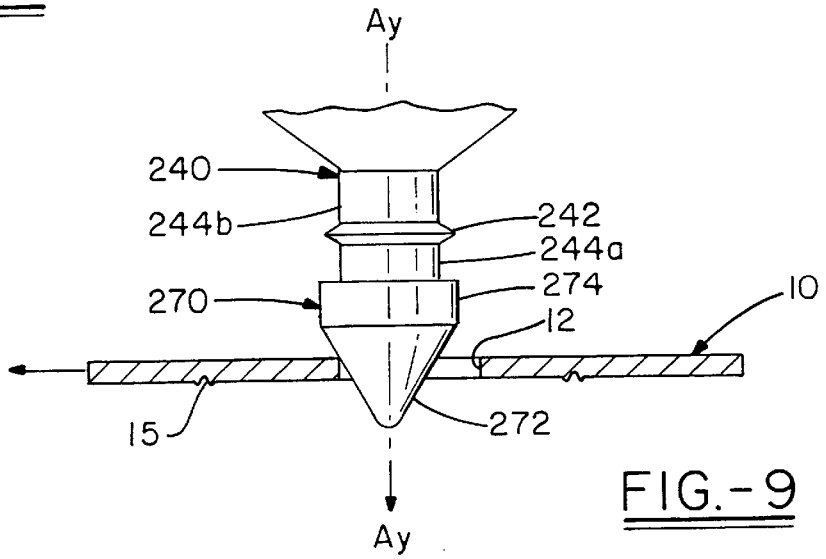
FIG. 9 is a partial elevational view illustrating an alternative configuration for the splitting-swaging tool to insure positioning of the circular disk blank axially on the machine Ay axis.

Referring now to FIG. 8 of the drawings, an additional technique for insuring registration of a disk blank 10 on the surface of the lower die member 120 and on the machine Ay axis is illustrated. According to this technique, a pair of studs 220 which may comprise bolts threaded into the lower die member 120 may be used to position a disk blank 10 as shown in the figure. Alternavitely and preferably the studs 220 may be part of a mechanism indicated generally by reference numeral 222 which includes a pair of movable arms 224. The movable arms 224 may be moved in the directions of arrows 226 to thus be adapted for positioning of various diameter disk blanks 10. The mechanism 222 comprising the arms 224 may be moved either by mechanical action or hydraulic action, and this, at the discretion of the machine designer. It is anticipated that, when the upper die member 130 is in the raised position for receiving a disk blank 10 into the machine, the positioning studs 220 will be located in positions to receive a disk blank on the surface of the lower die member 120. When the disk blank 10 is in the appropriate position on the machine Ay axis, the studs 220 are withdrawn and the upper die member lowered to effect clamping action of the disk blank for a machine splitting and swaging operation Referring to FIG. 9 of the drawings, an alternative way of insuring the correct positioning of a disk blank 10 on the machine Ay axis is illustrated. According to this technique, a splitting swaging tool 240 is configured with a pilot bolt extension indicated generally at reference numeral 270. The tool 240 is, of course, characterized by a splitting edge 242 and lower and upper swaging surfaces 244*a* and 244*b* respectively. The pilot bolt extension 270 may be a separate piece which is threaded or otherwise affixed to the end of the tool 240 or it may comprise part and parcel of the tool configuration. In any case, the pilot bolt 270 is characterized by a tapered or cone-shaped tip end 272 extending from a cylindrical base end 274. The base end 274 has a diameter substantially but not equal to the diameter of a bore 12 in a disk blank 10. From this it can be appreciated that, when a disk blank 10 is off center of the machine Ay axis as shown in the figure, downward movement of the tool 240 and thus also the pilot bolt 270 effects a movement of the disk blank by reason of the tapered end 272 and ultimately centering on the machine Ay axis as the disk blank reaches the cylindrical end 274 of the pilot bolt 270. The disk blank 10 may thus be centered such that the annular groove 15 engages the annular raised ring 125 on the lower die member 120. The tool 240 is moved downwardly until the splitting edge 242 is centered on the Bx horizontal axis and in this position the pilot bolt 270 is out of the way of tool action being below the disk blank 10 and within the chamber formed by the lower die member 120.

Figure 10:
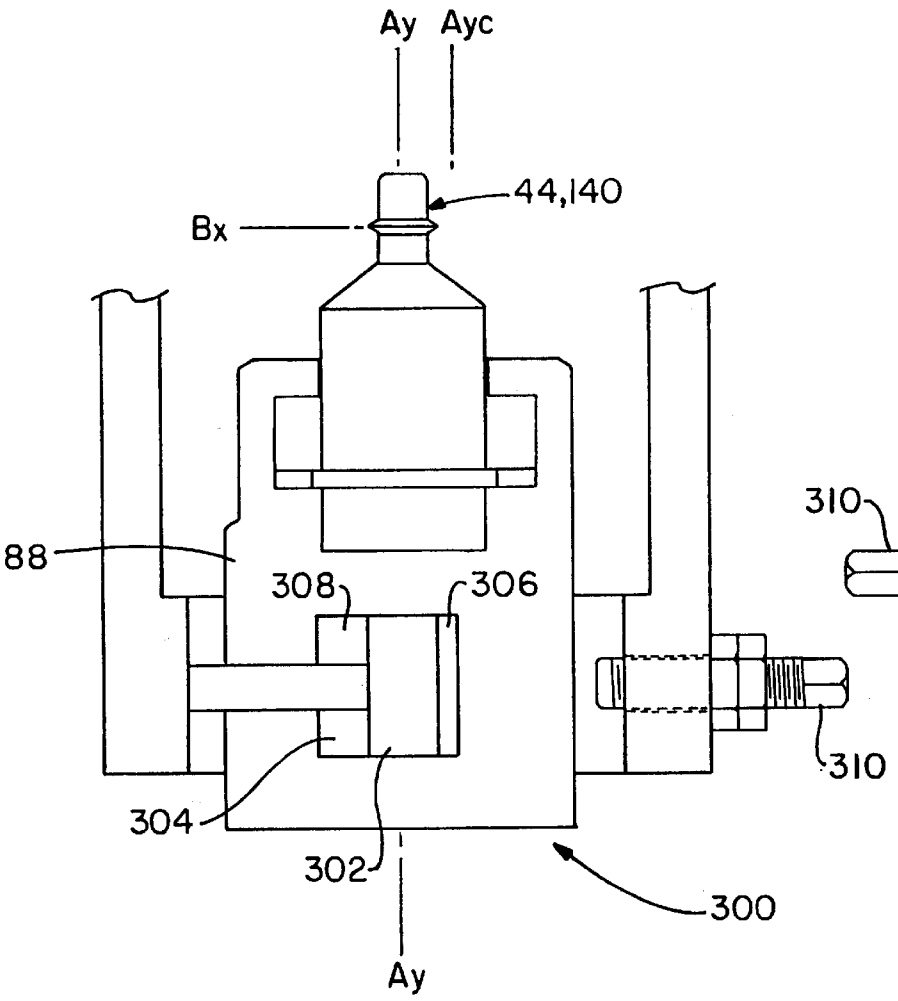
FIG. 10 is an elevational view, primarily schematic, illustrating an alternative configuration for the means which effects horizontal movement of the splitting-swaging tool on the Bx axis.

It was earlier stated in this description that the means 92 for moving the bore-splitting and swaging tool 44,140 may comprise either a mechanically or a hydraulically driven means. In FIG. 3 an embodiment for the means 92 is generally indicated by reference numeral 300 which is mounted in association with the tool spindle 88. This embodiment is more specifically shown in FIG. 10 of the drawings and it comprises a piston 302 that is carried within a chamber 304. The piston 302 is mounted in a stationary manner while the chamber 304 is an integral part of the spindle 88. When the chamber 304 is pressurized by an appropriate hydraulic fluid in one portion, for example in the portion indicated at reference numeral 306, it can be appreciated that the chamber 304 and thus also the tool-holding spindle 88 is moved to the right in the figure. When this happens, the chamber portion indicated at reference numeral 308 on the opposite side of the piston 302 is evacuated of fluid. Alternatively, when the chamber 308 is pressurized by fluid the spindle 88 is forced to move to left in the figure. The chamber portion 306 is then evacuated of hydraulic fluid. As shown by way of example in the figure, when the chamber 306 is pressurized and the spindle 88 is moved to the right, the chamber 304 may be stopped in its motion by a stop means 310. The stop means 310 may comprise a calibrated bolt the position of which may be changed to effect a change in the distance to be travelled by the tool 44,140. Of course, movement of the splitting-swaging tool 44,140 off of the machine Ay axis will effect reshaping of the disk blank bore 12.

Referring to FIG. 4 of the drawings, an alternative means 92 is illustrated and generally indicated by reference numeral 320. The means 320 comprises a rack and pinion configuration wherein a rack 322 is mounted in association with a tool spindle 170. The rack 322 moves the tool thru a path off of the machine Ay axis to thus effect tool reshaping of the disk blank bore 12. It is anticipated that the pinion 324 may be operated either mechanically or hydraulically in manners well known in the arts.

Figure 11:
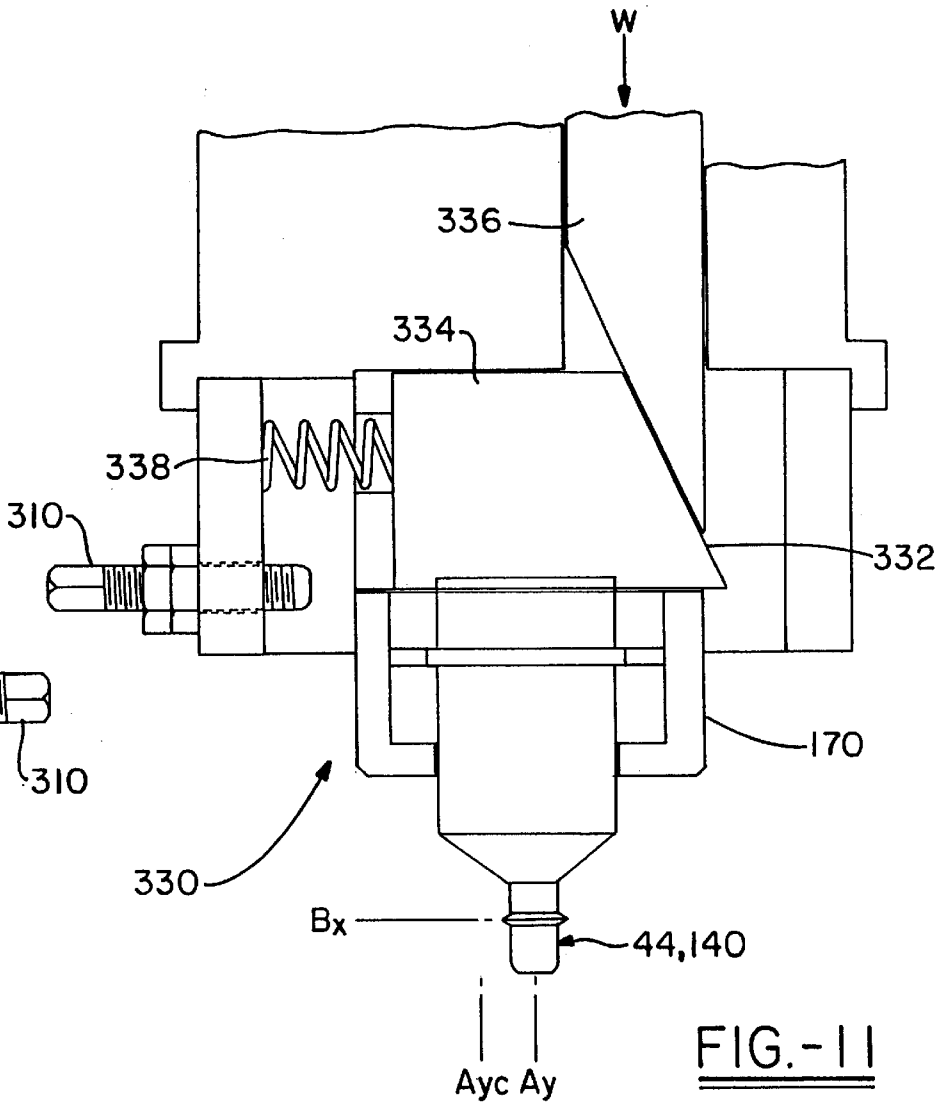
FIG. 11 is an elevational view, primarily schematic, illustrating still another configuration for the means which effects horizontal movement of the splitting-swaging tool on the Bx axis.

Another embodiment for the means 92 is illustrated in FIG. 11 of the drawings and generally indicated by reference numeral 330. The embodiment 330 comprises a tool-holding spindle 170 which is adapted to include a ramp member 332 at its opposite end 334. The ramp member 332 operates in conjunction with a wedge 336 which is forced downwardly by a force "W" as illustrated. The motion of the wedge 336 moves the ramp 332 to the left as indicated in the figure where its movement may be opposed by a means such as, for example, a spring 338. The extent of movement of the ramp 332 is limited by a calibrated bolt 310 as described hereinbefore and thus a tool 44,140 is also limited in its travel along the Bx axis. It should be appreciated that various disk blank bore diameters may be split and swaged using the same tool 44,140. Again, the operation of the wedge 336 may be done either mechanically or hydraulically in ways well-known in the arts.

Figure 12:
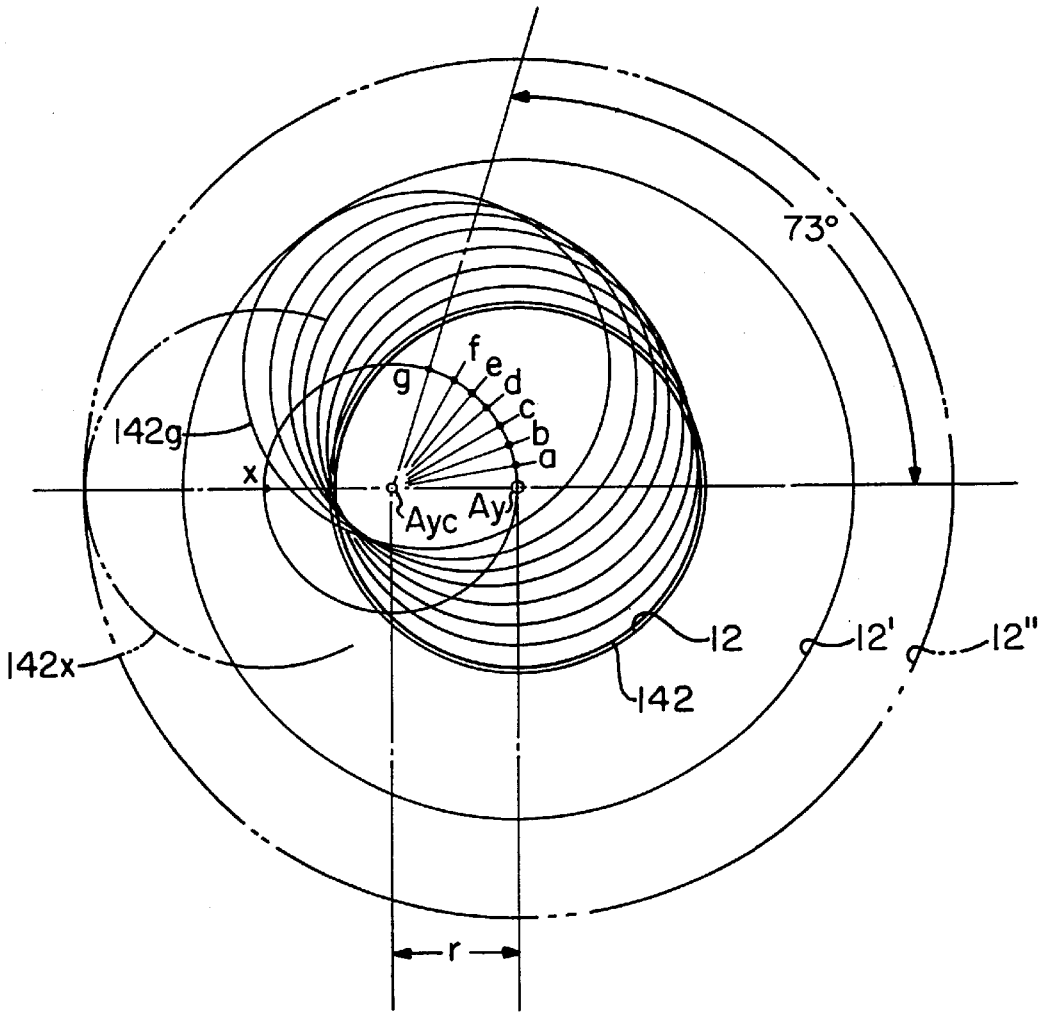
FIG. 12 is a plan view schematically illustrating the movement of the splitting-swaging tool as its mounting spindle is moved from the machine Ay axis to a parallel Ayc axis.

Referring now to FIG. 12 of the drawings, a plan view schematically illustrates the motion pathway of a tool 140 having a splitting edge 142 which effects forming of a disk blank bore 12 into a bearing retainer 20 as shown in FIG. 1C. For the purpose of example only, a splitting edge 142 is shown as it may be positioned axially on the machine Ay axis which is the same axial position of a rotatable disk blank 10 carried between upper and lower die members 130 and 120 respectively. The tool 140 is carried by its spindle 170 which is moved off of the machine Ay axis by its carrier 190 as shown in FIG. 5 and this, by a means 92 as described hereinbefore. In this example, it has been predetermined that the tool 140 must move through an arcuate path as indicated by the letters "a–g". The arcuate path is described by a circle having a radius "r" and the center of which is located at the Ayc parallel axis. The letters "a–f" are ten degree increments of the tool motion while the letter "g" is a thirteen degree increment such that the tool motion path is described through an angle of 73° as illustrated. The tool center of rotation thus moves from an initial position at the machine Ay axis to the "g" position which is 73° referenced to the Ayc axis. While in this example ten degree incremental movements of the tool are illustrated, in actual practice in a machine operation the tool 140 moves in a continuous uninterrupted motion from the Ay axial position to the "g" arcuate position. The tool 140 therefore enlarges an initial disk blank bore 12 dimension to a new bore dimension as indicated at reference numeral 12' in the figure. The tool splitting edge 142 is shown at the new position indicated at 142*g*. In a specific example, when a disk blank bore 12 is in axial position concentric with a tool splitting edge having a diameter of 0.8600 inch and the radius "r" describing an arcuate path "a–g" is 0.300 inch, and the tool is moved through 73° of arc as shown, a new bore dimension 12' exhibiting a diameter of 1.5748 inch may be realized when the tool splitting edge is at the position 142*g*.

From the foregoing description it may be realized that, by using the same tool 140, one may enlarge a disk blank bore 12 to a new dimension indicated at 12" in the figure. This may be accomplished by moving the tool 140 through 180° of arc to a position indicated at "x" such that the splitting edge 142 is moved to a position indicated at 142*x* in the figure. As hereinbefore stated, the above description is for the purpose of example only inasmuch as various changes may be made, such as for example, changing the tool dimensions and/or changing the location of the parallel Ayc axis as determined by the distance "r".

Referring again to FIGS. 3–5 of the drawings, the following description of the machine operations will apply to all of the figures wherein the first of a double set of reference numerals will apply to FIG. 3 while the second of the set will apply to FIGS. 4 and 5. In the figures, a controller is indicated at reference numeral 200 and it is shown schematically as including various outputs "A–G" which may be used to control various functions of the machine 50,150. Firstly and assuming that the machine 50,150 is in the rest condition and the upper die member 52,130 is in the raised position, a disk blank 10 is inserted into the machine onto the lower die member 54,120. In the embodiments of FIGS. 3–5, the disk blank 10 is registered on the machine Ay axis via bores 14 and mounting studs 54, 122 on the lower die member. Of course, the alternative disk blank centering means illustrated and described with reference to FIGS. 6–9 may be applied to accomplish the result.

To begin operations, the controller 200 sends a signal "A" to the power motor 70 feeding distributor 72 to effect lowering of the upper die member 52,130 via the machine hydraulic members 62,64,66 such that forceful engagement and clamping action of the disk blank 10 is achieved. When the force is at least 10K pounds, a signal "B" is sent to the main drive motor 86 to effect rotation of the lower die member 54,120. When the rotational speed of the disk blank 10 is at least 800 rpm, the controller 200 sends a signal "C" to the splitting tool 40 mechanism such as to effect engagement of the tool with the outer peripheral edge 16 of the disk blank 10. At about the same time, the controller 200 sends a signal "D" to the tool 42 such that its mechanism moves the tool to engage the split peripheral edge and effect swaging to a pulley groove 18. At a predetermined instant in time later, the controller 200 sends a signal "E" to the means 92 which effects movement of the splitting-swaging tool 44,140 off of the machine Ay axis to a parallel Ayc axis. This movement effects engagement with the disk blank bore 12, splitting of the bore, and swaging to a retainer flange 20 configuration. When the tools 40 and 42 and 44,140 have reached their predetermined limits of motion into the disk blank peripheral edge 16 and bore 12, the controller 200 sends signals reversing tool movement such that they return to their initial machine positions. The main drive motor 86 is shut down to halt rotational motion and a signal "F" is sent to reverse hydraulic function such as to move the upper die member 52,130 to the raised initial machine position. As described earlier with respect to machine lubrication, a signal "G" is sent from the controller 200 to close the valves 254 which supply lubricant 252 to the various tool operations. The finished product is removed from the machine and a new disk blank 10 is inserted for the next machine operation.

While the bore-splitting and swaging tools 44,140 have been illustrated as being mounted either in association with the machine base and oriented upwardly as in FIG. 3 to operate on the disk blank 10, it will be recognized that the alternative configuration may be applied wherein the tool is carried in association with upper machine members and oriented downwardly to operate on a disk blank 10 as shown in FIG. 4. Thus, the tool 44 in FIG. 3 may be configured to operate from the top end of the machine as in FIG. 4 while the tool 140 in FIG. 4 may be configured to operate from the bottom end of the machine as in FIG. 3. Of course when alternatives of this type are made, the means 92 for moving the tool to a parallel Ayc axis will also be mounted in the same orientation These changes are considered within the scope of the present invention.

While certain representative embodiments and details have been shown for the purpose of illustrating this invention, it will be apparent to those skilled in this art that various changes and/or modifications may be made therein without departing from the spirit or scope of the invention.

What is claimed is:

1. A machine having primary Ay vertical and Bx horizontal axes to spinform a flat circular disk blank having a central bore into a pulley configuration exhibiting an outer peripheral pulley groove and bore flanges to contain a bearing, the machine comprising in combination:

a base member and an upper frame member, the frame member being movable along the Ay axis toward and away from the base member;

means for positioning and maintaining the disk blank axially on the machine Ay vertical axis and planarly on the machine Bx horizontal axis, said means comprising an upper annular die rotatably carried by the upper frame member and a lower annular die rotatably carried by base member, adapted for clamping engagement of the disk blank between them when the frame member is lowered toward the base member, the upper die member having a downwardly facing flat annular surface and the lower die having an upwardly facing flat annular surface, the downwardly facing surface of the upper die bearing against an upper flat surface of the disk blank and the upwardly facing surface of the lower die bearing against a downwardly facing flat surface of the disk blank the surfaces of the disk blank and the die forming contacting surfaces with each other when the dies are moved toward each other;

at least one concentric annular groove located in at least a first one of the contacting surfaces of either the disk blank or one of the dies and at least one matching annular rib on the oppositely facing contacting surface which bears against the first contacting surface having the annular groove, the annular rib extending into the annular groove to prevent relative lateral movement of the workpiece when it is clamped between the upper and lower dies;

means for effecting rotation of at least one of the die members such that both die members and the disk blank rotate at the same speed;

a splitting tool positioned and movable on the Bx horizontal axis to engage the outer peripheral edge and effect spitting of the edge;

a swaging tool positioned and movable on the Bx horizontal axis to engage the outer peripheral edge and effect swaging of the edge into a pulley groove configuration;

a splitting-swaging tool carried within a chamber formed by the annular dies members to effect splitting and swaging of the disk blank bore to form upwardly and downwardly oriented bore flanges;

a rotatable spindle carried by one of the dies and adapted for rotatably mounting of the splitting-swaging tool on the machine Ay axis and movable horizontally such that the tool engages the disk blank bore; and means for moving the rotatable spindle a specific distance horizontally such that the tool engages the disk blank bore.

2. The machine as claimed in claim 1 wherein the means for effecting rotational motion comprises an electric motor driving one of the die members through a spur-ring gear combination.

3. The machine as claimed in claim 1 wherein the means for effecting rotational motion comprises an electric motor driving an axially positioned spindle which carries a cone-shaped die member for rotational motion about the machine Ay axis.

4. The machine as claimed in claim 1 wherein the means for moving the rotatable spindle adapted for mounting of the splitting-swaging tool comprises a stationary piston and a movable piston chamber, the piston chamber comprising part of the spindle such that selective pressurization of the chamber on either side of the piston effects horizontal movement of the spindle and thus also the splitting-swaging tool a specific distance.

5. The machine as claimed in claim 1 wherein the means for moving the rotatable spindle adapted for mounting of the splitting-swaging tool comprises a rack and pinion and the rack is carried in association with the spindle such that a rotation of the pinion effects horizontal movement of the spindle and thus also the splitting-swaging tool a specific distance.

6. The machine as claimed in claim 1 wherein the means for moving the rotatable spindle adapted for mounting of the splitting-swaging tool comprises a ramp and wedge and the ramp is carried in association with the spindle such that a vertical movement of the wedge effects horizontal movement of the spindle and thus also the splitting-swaging tool a specific distance.

7. The machine as claimed in claim 1 wherein all tool motions are controlled by an electronic controller.

8. The machine as claimed in claim 1 wherein positioning of the disk blank between the die members is accomplished by a stamped annular groove in at least one surface of the disk blank and a matching raised annular ring on the surface of the lower die member.

9. The machine as claimed in claim 1 wherein positioning of the disk blank between the die members is accomplished by a splitting-swaging tool having a locating stud extension characterized by a tapered tip end extending from a cylindrical base end, the base end exhibiting a diameter substantially but not equal to the diameter of the bore in the disk blank.

10. The machine as claimed in claim 1 wherein the tools which effect splitting and swaging of the outer peripheral edge of the disk blank are lubricated by spraying apparatus while the splitting-swaging tool is lubricated by lubricant forced into the chamber formed by the cone-shaped die members.

11. The machine as claimed in claim 10 wherein the upper die member has a plurality of lubricant distributing vanes on its inside surface which direct lubricant into the working area of the splitting-swaging tool and the lubricant is forced into the chamber at the upper end of the die member.

12. The machine as claimed in claim 1 wherein all tool motions are controlled by an electronic controller and lubricated by a pressurized lubricant passing through a plurality of valves controlled by the controller.

13. The machine as claimed in claim 1 wherein upper frame member is moved hydraulically and one of the die members is rotated by action of an electric motor.

14. The machine as claimed in claim 13 wherein a hydraulic power source acting through a distributor provides hydraulic functioning of the frame member and both the hydraulic power source and electric motor are under the control of an electronic controller.

15. The machine as claimed in claim 1 wherein the rotatable spindle adapted for rotatably mounting of the splitting-swaging tool is moved off of the machine Ay axis a distance equal to the radius of a circle and the axial center of the tool is moved along an arc of the circle a distance as may be described by an angle whose center is at the center of the circle.

16. An apparatus for spin forming a circular flanged body from a flat metal workpiece having a center opening therein comprising:

clamping means formed by an upper annular die and a lower annular die gripping a top and bottom surface of the workpiece, the clamping means and workpiece being rotatable about a fixed axis, the upper die member having a downwardly facing flat annular surface and the lower die having an upwardly facing flat annular surface, the downwardly facing surface of the upper die bearing against an upper flat surface of the disk blank and bearing against a downwardly facing flat surface of the disk blank the surfaces of the disk blank and the die forming contacting surfaces with each other when the dies are moved toward each other;

at least one concentric annular groove located in at least a first one of the contacting surfaces of either the disk blank or one of the dies and at least one matching annular rib on the oppositely facing contacting surface which bears against the first contacting surface having the annular groove, the annular rib extending into the annular groove to prevent relative lateral movement of the workpiece when it is clamped between the upper and lower dies;

an outer circular splitting tool;

an outer tool carrier means for moving the outer tool radially inwardly against an outer periphery of the workpiece;

an inner circular splitting tool;

an inner tool carrier means for moving the inner tool radially outwardly against an inner peripheral edge in the center opening of the workpiece;

the both the outer and inner splitting tool each being rotatable about a separate laterally moveable axis which is parallel to the fixed axis of rotation of the clamping means and the workpiece; and means moving the axis of the outer tool toward the axis of rotation of the workpiece to cause the outer tool to cut into the outer periphery of the workpiece as the axis of rotation of the outer tool is moved toward the axis of rotation of the workpiece;

means moving the axis of the inner tool away from the axis of rotation of the workpiece to cause the inner tool to cut into the inner periphery of the workpiece as the axis of rotation of the inner tool is moved away from the axis of rotation of the workpiece;

the inner and outer tools simultaneously splitting the inner and outer peripheries of the workpiece and forming a pair of integral flanges on both the outer and inner periphery of the workpiece.

17. A machine having a rotational axis to spinform a flat circular disk blank having a central bore into a pulley configuration exhibiting an outer peripheral pulley groove and bore flanges to contain a bearing, the machine comprising:

a first frame member and a second frame member, the second frame member being moveable along the rotational axis toward and away from the first frame member, means for positioning and maintaining the disk blank centered axially on the machine rotational axis and planarly perpendicular to the rotational axis, said means comprising a first annular die member rotatably carried by the first frame member and second annular frame member rotatably carried by the second die member, said die members adapted for clamping engagement of the disk blank between them when the second frame member is moved toward the first frame member, the upper die member having a downwardly facing flat annular surface and the lower die having an upwardly facing flat annular surface, the downwardly facing surface of the upper die bearing against an upper flat surface of the disk blank and the upwardly facing surface of the lower die bearing against a downwardly facing flat surface of the disk blank the surfaces of the disk blank and the die forming contacting surfaces with each other when the dies are moved toward each other;

at least one concentric annular groove located in at least a first one of the contacting surfaces of either the disk blank or one of the dies and at least one matching annular rib on the oppositely facing contacting surface which bears against the first contacting surface having the annular groove, the annular rib extending into the annular groove to prevent relative lateral movement of the workpiece when it is clamped between the upper and lower dies;

means for effecting rotational motion of at least one of the die members such that both die members and the disk blank rotate at the same speed;

a splitting tool positioned and movable toward the disk blank to engage the outer peripheral edge of the disk blank and effect splitting of the edge;

a swaging tool positioned and movable toward the disk blank to engage the outer peripheral edge after the edge has been split and effect swaging of the edge into a pulley groove configuration;

a splitting-swaging tool carried inside the annular die members to effect splitting and swaging of the disk blank bore to form oppositely extending bore flanges;

a rotatable spindle adapted for rotatably mounting of the splitting-swaging tool on the rotational axis of the machine such that the tool engages the disk blank bore upon transverse movement of spindle; and means for moving the rotatable spindle transversely a specific distance such that the tool engages the disk blank bore.

18. The machine as claimed in claim 17 wherein the at least one annular groove is located in one of the contacting surfaces of the disk blank and the at least one matching rib is located on an oppositely facing contacting surface of one of the dies.

19. The machine as claimed in claim 17 wherein the at least one annular groove is located in the downwardly facing flat surface of the disk and the annular rib is located on the upwardly facing flat surface of the lower die.

20. The machine as claimed in claim 17 wherein the means for positioning and maintaining the disk blank includes a splitting-swaging tool includes a locating stud extension having a tapered tip end extending from a cylindral base end, the base end exhibiting a diameter slightly less that the diameder of the bore in the disk blank.

* * * * *